US005142587A

United States Patent [19]

Kobayashi

[11] Patent Number: 5,142,587

[45] Date of Patent: Aug. 25, 1992

[54] INTRA-CONCHA TYPE ELECTROACOUSTIC TRANSDUCER FOR USE WITH AUDIO DEVICES ETC.

[75] Inventor: Yukio Kobayashi, Tokyo, Japan

[73] Assignee: Foster Electric Co., Ltd., Japan

[21] Appl. No.: 537,790

[22] Filed: Jun. 14, 1990

[30] Foreign Application Priority Data

Jun. 16, 1989 [JP] Japan ..... 1-153710

[51] Int. Cl.[5] ..... H04R 25/00; G10K 11/00

[52] U.S. Cl. ..... 381/187; 381/183; 381/182; 381/150; 381/68.6; 181/126; 181/128; 181/129

[58] Field of Search ..... 381/183, 187, 68, 68.6, 381/69, 150, 182; 181/129, 126, 128

[56] References Cited

U.S. PATENT DOCUMENTS

| | | | |
|---|---|---|---|
| 3,170,046 | 2/1965 | Leale | 381/68.6 |
| 3,783,201 | 1/1974 | Weiss et al. | 381/68.6 |
| 4,668,842 | 5/1987 | Yokoyama et al. | 381/183 |
| 4,742,887 | 5/1988 | Yamagishi | 181/129 |
| 4,803,853 | 2/1989 | Hoerkers | 381/68.6 |
| 4,965,838 | 10/1990 | Kamon et al. | 381/187 |
| 4,972,492 | 11/1990 | Tanaka et al. | 381/187 |
| 5,048,090 | 9/1991 | Geers | 381/68 |

FOREIGN PATENT DOCUMENTS

| | | | |
|---|---|---|---|
| 3210034 | 11/1982 | Fed. Rep. of Germany | 381/187 |

*Primary Examiner*—James L. Dwyer
*Assistant Examiner*—William Cumming
*Attorney, Agent, or Firm*—Leydig, Voit & Mayer

[57] ABSTRACT

An intra-concha type electroacoustic trasducer has an auxiliary supporter projecting in opposite direction to entrance part of external auditory meatus of the user's ear from a side of the transducer opposite to its sound-radiating side disposed to face the auditory meatus entrance. Reliable mountability of the transducer with respect to auricle of the user's ear is thereby ensured, while an unpleasantness or pain given to the user upon mounting to the auricle can be at least reduced to a remarkable extent.

7 Claims, 2 Drawing Sheets

INTRA-CONCHA TYPE ELECTROACOUSTIC TRANSDUCER FOR USE WITH AUDIO DEVICES ETC.

BACKGROUND OF THE INVENTION

This invention relates to electroacoustic transducers and, more particularly, to intra-concha type electroacoustic transducers which reproduce sounds from audio signals provided by audio devices and the like for listening. The intra-concha type electroacoustic transducers of the kind referred to are effectively utilizable with portable audio devices and can be made to be dual-ear type for adaption to stereophonic mode.

DESCRIPTION OF RELATED ART

With rapid increase in demand for and in types of portable audio devices in these days, the intra-concha type electroacoustic transducer which is small, light and very handy has been increasingly widely used. At the same time, it has been demanded that the electroacoustic transducers of the kind referred to reduce the burden on the user's ear upon long hour use and improve acoustic such as tone quality of the reproduced sound. Typical electroacoustic transducers, for example, are inserted into external auditory meatus continuous to concha forming the entrance cavity in the external ear however, this causes the peripheral wall of the external auditory meatus to receive excessive amounts of pressure, thus giving the user an oppressive sensation, and creating a remarkable unpleasantness or pain at the external auditory meatus.

In order to eliminate the above-noted problem, there have been suggested in Japanese Patent Publication No. 63-42999 and Japanese Patent Appln. Laid-Open Publication No. 59-221199, respectively of Y. Yokoyama et al such inner-ear type electroacoustic transducers which comprise a casing formed to be circular in contour and curved at a front face for mounting therein an electroacoustic transducer element or a speaker unit, the casing being disposed, when mounted to a concha in the user's ear, to be inside the tragus and antitragus, that is, on the side of the external auditory meatus, so as to be supported at three points of both tip ends of the tragus and antitragus and of an inner portion of the auricle of the user's ear. With this arrangement, it appears that the unpleasantness or pain may be alleviated to some extent as compared with the foregoing electroacoustic transducer of the type which is urged into the external auditory meatus. In view, however, that the tragus, antitragus and concha are subject to a wide variety in their position and shape depending on individual users, a problem remains unsolved in that the electroacoustic transducer too large in size will cause the user extreme unpleasantness or pain and the one too small cannot be reliably seated in the concha so as to be easily caused to escape out of auricle.

In the foregoing Japanese Patent Appln. Laid-Open Pub. No. 59-221199 of Y. Yokoyama et al, further, there has been also suggested an arrangement in which merely a diaphragm of the electroacoustic transducer is disposed in concha as opposed to the entrance of external auditory meatus, but this arrangement is still defective in that the transducer is seated in the concha insufficiently and is thus eventually insufficient in providing any measure for sound leakage.

SUMMARY OF THE INVENTION

A primary object of the present invention is, therefore, to provide an intra-concha type electroacoustic transducer for use with the audio devices and the like, which remarkably reduces or fully removes the unpleasantness or pain that the user may have upon mounting of the transducer and is still capable of maintaining high-quality acoustic characteristics.

According to the present invention, this object can be realized by an intra-concha type electroacoustic transducer which comprises a housing for accommodating therein a speaker unit including a diaphragm to be detachably mounted to the concha of the user's ear, with the diaphragm of the speaker unit disposed to oppose the entrance portion of the external auditory meatus of the ear. An auxiliary means is projected from the housing in a direction opposite to the entrance portion of the external auditory meatus for supporting the housing in said mounted position.

Other objects and advantages of the present invention shall be made clear in following description of the invention detailed with reference to the accompanying drawings.

While the present invention shall now be described with reference to the embodiment shown in the accompanying drawings, it should be appreciated that the intention is not to limit the invention only to the embodiment shown but rather to include all alterations, modifications and equivalent arrangements possible within the scope of appended claims.

DETAILED DESCRIPTION OF THE PREFERRED EMBODIMENT

Figure 1:
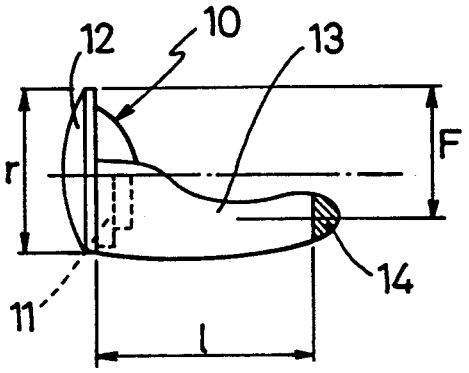
FIG. 1 is a schematic plan view of the intra-concha type electroacoustic transducer for use with the audio devices and the like in a preferred embodiment according to the present invention.
Figure 2:
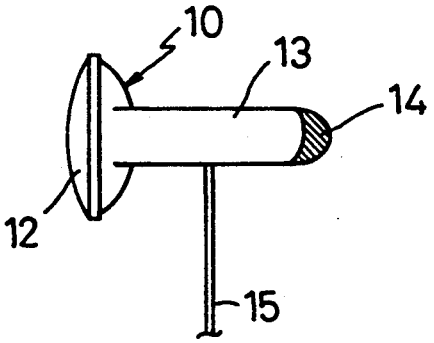
FIG. 2 is a side elevation of the electroacoustic transducer of FIG. 1.

Referring to FIGS. 1 and 2, the electroacoustic transducer according to the present invention comprises a semidome shape housing 10, which is formed preferably with highly flexible plastics or the like to be capable of being held by the tragus, the antitragus and a conchal wall portion in auricle of the user's ear for being seated in the conchal cavity with a front face of the housing 10 disposed to oppose the entrance portion of the external auditory meatus inside the conchal cavity. The housing 10 accommodates therein a speaker unit 11, and a protector 12 of a contour curved into a convex shape and perforated to have many ventilating holes is mounted to the front face of the housing 10. On the side opposite to the front face, an auxiliary supporter 13 is provided for the housing 10 and is preferably integrally molded with the housing 10 by flexible plasters so as to project in a direction opposite to the entrance portion of the external auditory meatus. This auxiliary supporter 13 is made hollow and preferably provided at a projected end with a flexible cushion 14.

In the present instance, the housing 10 may have a diameter rof, for example, about 15mm, while the auxiliary supporter 13 may be of a length lof, for example, about 18mm, but proper dimension will be selected as occasion demands since the user's auricle is variable in shape and dimension with such various factors as the user's height and so on. For the plastics with which the housing 10 and auxiliary supporter 13 are formed integrally, it is desirable to select one which is less slippery with respect to human skin at the respective auricle portions where the housing 10 and supporter 13 engage and is easily deformable so that the user will not have any unpleasant feeling or pain upon mounting of the transducer in the user's concha. More concretely, it is preferable to employ polyvinyl chloride, urethane or silicone resin and the like, and molded product should preferably be subjected to a surface treatment for a graining and the like.

Figure 3:
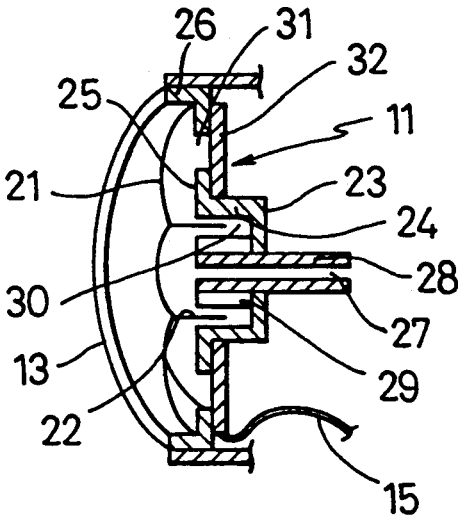
FIG. 3 shows in a sectioned view a speaker unit in the electroacoustic transducer of FIG. 1.

The speaker unit 11 is not required to be specifically limited in the structure, but such a structure as shown in FIG. 3 may preferably be employed. That is, this speaker unit 11 of FIG. 3 comprises a diaphragm 21 disposed for opposing the entrance portion of the external auditory meatus through the foregoing protector 12 which is thus disposed as slightly spaced from the diaphragm 21. In this speaker unit 11, the diaphragm 21 is coupled to an end of a cylindrical voice coil 22 disposed on the other side of the diaphragm 21 than the protector 12 and in axial alignment with the diaphragm 21, while the voice coil 22 is inserted partly at the other free end in a magnetic circuit including a yoke 23. More concretely, this yoke 23 comprises a central recessed part 24 in which the voice coil 22 is partly inserted, a peripheral flange part 25 continuous to the front side end periphery of the recessed part 24, and an outer support frame part 26 provided to peripheral part of the flange part 25, the parts forming as a whole a relatively deep saucer. In the center of the recessed part 24, a thin pipe member 28 defining a penetrating sound path 27 is passed through the recessed part 24, and an annular permanent magnet 29 is provided inside the recesses part 24 to axially engage therewith and to surround the pipe 28. A magnetic gap 30 is defined between the annular permanent magnet 29 and inner peripheral wall of the central recessed part 24 so that the free end of the voice coil 22 is partly disposed in this magnetic gap 30. The peripheral flange part 25 is made to have through holes 31 mutually separated in circumferential direction, and a braking member 32 is disposed against the flange part 25 on its rear side to close the through holes 31. The outer support frame part 26 is provided to engage at its outer periphery with inner peripheral wall surface of the housing 10 while an outer peripheral edge of the diaphragm 21 is secured to inner periphery of the support frame part 26.

Now, as an audio signal is applied through a wire 15 to the voice coil 22, the latter is caused to vibrate in axial direction under the influence of the magnetic circuit and eventually the diaphragm 21 is vibrated together with the voice coil 22. In the mounted state of the electroacoustic transducer in the user's ear, reproduced sound from the speaker unit 11 can be heard through the external auditory meatus.

Figure 4:
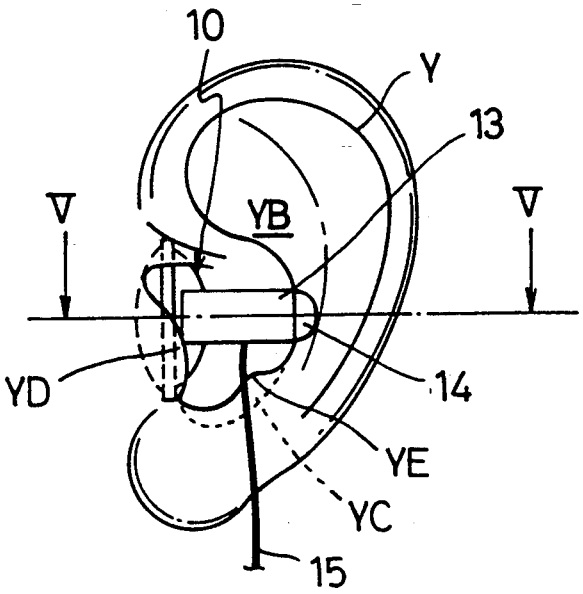
FIG. 4 is an explanatory view for a state in which the electroacoustic transducer of FIG. 1 is mounted to the user's ear.
Figure 5:
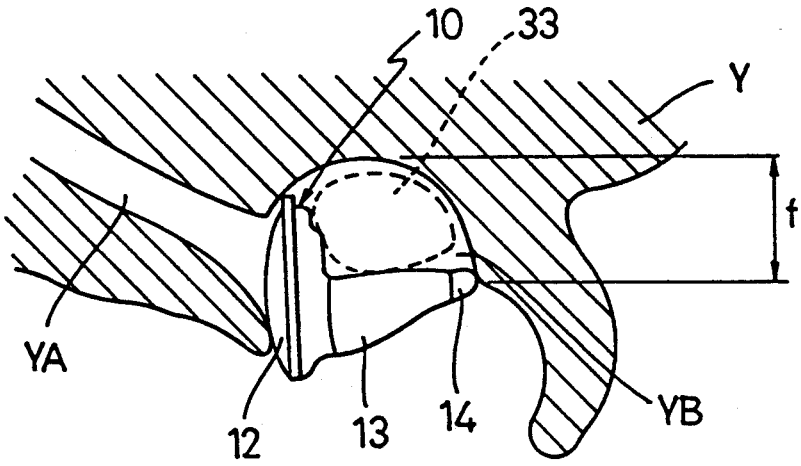
FIG. 5 is a sectioned view of the transducer in the mounted state as taken along line V—V in FIG. 4.

Further, references shall be made to a working aspect of the electroacoustic transducer according to the present invention, with reference to FIGS. 4 and 5. In mounting the electroacoustic transducer into the user's auricle Y, the transducer housing 10 is seated in the cavity YC of concha YB with the protector 12 and diaphragm 21 in the speaker unit 11 disposed to oppose the entrance portion of the external auditory meatus YA. The housing 10 in this case engages a wall portion of the conchal cavity YC and tip ends of both the tragus YD and antitragus YE, and is thereby supported. Concurrently with such seating of the housing 10 into the concha YB, the cushion 14 of the auxiliary supporter 13 projecting in the direction opposite to the auditory meatus YB is brought into engagement with an inner wall portion of the antihelix of auricle Y with the auxiliary supporter 13 compressed. Since the auxiliary supporter 13 is formed to be hollow and integral with the housing 10 by the highly flexible plastics easily deformable, the auxiliary supporter 13 is sufficiently soft enough for allowing the endwise cushion 14 to lightly engage a corresponding antihelix portion under a proper depression. The housing 10 integral with the auxiliary supporter 13 is thereby made to be reliably held in position between the wall portion of the concha YB and tip ends of the tragus YD and antitragus YE while engaging them extremely softly without providing any pain or unpleasantness to the user. In addition to the sufficient improvement in the mountability to the auricle and the stability of the transducer the positioning of the protector 12 on the front side of the housing and the diaphragm 21 of the speaker unit 11 at the entrance portion of the external auditory meatus YA enables the transducer to minimize sound leakage, to elevate sound pressure, and to substantially reduce any audible sound to people other than the user.

Here, it is preferable that the dimension of the electroacoustic transducer is so determined as to satisfy the relationship $F \leqq f$ in which F denotes a diametral separation between the tip end position of the auxiliary supporter 13 and the diametrally furthest position at the periphery of the housing 10, as presented in FIG. 1, and fdenotes a distance between the tip end position of the supporter 13 and the deepest position of the concha YB, as presented in FIG. 5, so that the electroacoustic transducer can be snugly yet comfortably secured in the auricle.

Further, as demanded, it may be useful to provide to the transducer a cushion member 33 as shown by a dotted line in FIG. 5, so as to swell over a space extending from the housing 10 to the extended end of the auxiliary supporter 13 and between the auxiliary supporter 13 to the bottom of the concha YB, to further restrain any pain or unpleasantness that might be given when the transducer is used for long hours. Further, while the auxiliary supporter 13 has been disclosed in the above to be provided at the projected end with the cushion 14, it may be possible to replace the cushion 14 by means of such slip-preventing treatment as satin-embossed finish.

It will be readily appreciated that the electroacoustic transducer of the foregoing structure can be mounted in the user's auricle as softly fitted thereto with a sufficiently elevated airtightness for remarkably reducing any sound leakage, so that sound pressure can be improved thus improving the acoustic characteristics while eliminating any interference to people other than the user due to the sound leakage.

What is claimed is:

1. An intra-concha type electroacoustic transducer comprising:

a housing having a speaker unit including a diaphragm, said housing being detachably mounted to a concha of a user's ear such that the diaphragm in the speaker unit is disposed to oppose an entrance portion of an external auditory meatus of the ear; and auxiliary supporting means extending longitudinally from said housing in a direction opposite to the entrance portion of said external auditory meatus such that upon insertion into a user's ear said supporting means is urged against the anti-helix of the user's ear and said housing is securely lodged between the tragus, antitragus, and the conchal wall.

2. The transducer of claim 1 wherein said housing and said auditory supporting means are integrally molded with a highly flexible plastic.

3. The transducer of claim 2 wherein said auditory supporting means is a hollow tube.

4. The transducer of claim 3 wherein said supporter is provided at a tip end with a slip-preventing means.

5. The transducer of claim 4 wherein said slip preventing means is a cushion.

6. The transducer of claim 1 further comprising a cushion member to be disposed between the transducer and the bottom part of the concha of the user's ear.

7. An intra-concha type electroacoustic transducer comprising:

a housing having a speaker unit including a diaphragm, said housing being mountable opposite an entrance portion of an external auditory meatus of a user's ear; and an auditory support consisting of a longitudinal member extending from said housing in a plane substantially perpendicular to a face of said housing for securing said housing in the user's ear between the tragus, the antitragus and the conchal wall such that the diaphragm opposes the external auditory meatus of the ear and said support engages the anti-helix of the ear.

* * * * *

UNITED STATES PATENT AND TRADEMARK OFFICE

CERTIFICATE OF CORRECTION

PATENT NO. : 5,142,587

DATED : August 25, 1992

INVENTOR(S) : Yukio Kobayashi

It is certified that error appears in the above-identified patent and that said Letters Patent is hereby corrected as shown below:

Item no. 57, Abstract, line 1, change "trasducer" to --transducer--.

Signed and Sealed this

Fourteenth Day of September, 1993

*Attest:*

*Attesting Officer*

BRUCE LEHMAN

*Commissioner of Patents and Trademarks*